US008776338B2

(12) United States Patent
Yuan

(10) Patent No.: US 8,776,338 B2
(45) Date of Patent: Jul. 15, 2014

(54) SINGLE HANDLE PULLING RIVETING GUN

(76) Inventor: Jianming Yuan, Yuyao (CN)

( * ) Notice: Subject to any disclaimer, the term of this patent is extended or adjusted under 35 U.S.C. 154(b) by 0 days.

(21) Appl. No.: 13/885,976

(22) PCT Filed: Nov. 14, 2011

(86) PCT No.: PCT/CN2011/082155

§ 371 (c)(1),
(2), (4) Date: Jun. 17, 2013

(87) PCT Pub. No.: WO2012/065532

PCT Pub. Date: May 24, 2012

(65) Prior Publication Data

US 2014/0137379 A1 May 22, 2014

(30) Foreign Application Priority Data

Nov. 20, 2010 (CN) ..... 2010 1 0566031

(51) Int. Cl.
*B21J 15/30* (2006.01)
*B21J 15/10* (2006.01)

(52) U.S. Cl.
CPC ..... *B21J 15/105* (2013.01)
USPC ..... 29/243.521; 29/243.527; 72/391.4

(58) Field of Classification Search
CPC ..... B21J 15/043; B21J 15/38; B21J 15/386; B21J 15/105
USPC ..... 29/243.521, 243.527, 243.528; 72/391.4
See application file for complete search history.

(56) References Cited

U.S. PATENT DOCUMENTS 3,048,296 A * 8/1962 Heidenwolf ..... 29/243.521
6,085,400 A 7/2000 Liu

FOREIGN PATENT DOCUMENTS

| | | |
|---|---|---|
| CN | 1743098 | 3/2006 |
| DE | 2805909 | 10/1978 |
| GB | 853669 | 11/1960 |

OTHER PUBLICATIONS

PCT/CN2011/082155, International Search Report mailed Mar. 1, 2012, 2 pages—English.
PCT/CN2011/082155, Written Opinion mailed Feb. 12, 2012, 3 pages—Chinese, 1 page—English.

* cited by examiner

*Primary Examiner* — David B Jones
(74) *Attorney, Agent, or Firm* — Andrew F. Young, Esq.; Lackenbach Siegel, LLP

(57) ABSTRACT

A single handle pulling riveting gun is disclosed. The single handle pulling riveting gun includes a body, a handle, a pulling rod, a grabbing mechanism, a riveting regulating mechanism, a first pin shaft, a second pin shaft, a third pin shaft and a moving piece. The riveting regulating mechanism cooperates with a front end of the body, the grabbing mechanism is set on a chamber of the riveting regulating mechanism; a rear end of the grabbing mechanism cooperates with the pulling rod.

9 Claims, 4 Drawing Sheets

SINGLE HANDLE PULLING RIVETING GUN

CROSS REFERENCE TO RELATED APPLICATIONS

This application claims priority to International PCT Ser. No. PCT/CN2011/082155 filed Nov. 14, 2011, the entire contents of which are incorporated herein fully by reference, which in turn claims priority to CN Ser. No. 201010566031.5 filed Nov. 20, 2010.

TECHNICAL FIELD

The patent application relates to riveting tool technical field, and particularly relates to a single handle pulling riveting gun.

BACKGROUND

Pulling riveting gun are now widely used in all kinds of sheet metal, tubes and other manufacturing industrial fastening riveting in automobile, aviation, railway, refrigeration, elevator, switches, instruments, furniture, decoration and other mechanical and electrical riveting and light industrial products. Pulling riveting gun mainly fixes the defect of fusible metal sheet and thin tube welding nut, easy sliding tooth of tapping internal thread; and rivets pull riveting product which have no internal thread and welding nut riveting. Pulling riveting gun rivets securely with high efficiency and easy using. Pull riveting rather than pressure riveting and rise riveting should be used if a product of the nut needs to be mounted on the outside with narrow inside space, and the pressure head of riveting machine cannot entry to carry out the pressure riveting and pumping and cannot meet the requirements of strength. Pulling riveting gun is suitable for the plate in various thicknesses, tube (0.5 mm-6 mm) in binding filed. Using pneumatic or manual Pulling riveting gun can rivet securely at one time, conveniently and firmly and can overcome the defects of metal sheet, fusible thin pipe welding, and uneasy welding nut.

The existing pulling riveting gun can be divided into a single handle pulling riveting gun and a double handle pulling riveting gun. The double handle pulling riveting gun includes two handles. When riveting, a user holds the two handles with two hands respectively to rivet. The single handle pulling riveting gun includes a body and a handle. When riveting, a user holds the body and the handle with one hand to rivet.

However, the handle and body of the existing single handle pulling riveting gun is connected through a pin shaft. During the process of using the pulling riveting gun, a torque to move the leverage up remains the same. In the process of riveting, the resistance increases, the force required increases accordingly. A user need to a lot of force to finish riveting.

SUMMARY

The embodiments of the present patent application provide a single handle pulling riveting gun to overcome the above defects.

Accordingly to one aspect of the present patent application, a single handle pulling riveting gun includes a body, a handle, a pulling rod, a grabbing mechanism, a riveting regulating mechanism, a first pin shaft, a second pin shaft, a third pin shaft and a moving piece. The riveting regulating mechanism cooperates with a front end of the body, the grabbing mechanism is set on a chamber of the riveting regulating mechanism; a rear end of the grabbing mechanism cooperates with the pulling rod. The first pin shaft is mounted on the body. The second pin shaft is mounted on the handle and connected with the first pin shaft by the moving piece. The third pin shaft is mounted on the handle and the pulling rod simultaneously.

In one embodiment, a rear end of the body is fixed with a pulling rod position seat, and the riveting regulating mechanism comprises a regulating sleeve tube, a rear end of the pulling rod is located in a center hole of the pulling rod position seat, a front end of the pulling rod stretches into the regulating sleeve tube, the pulling rod moves linearly along a direction determined by the pulling rod position seat and the regulating sleeve tube.

In one embodiment, the riveting regulating mechanism comprises a riveting guiding mouth, a regulating sleeve tube and a regulating nut. A rear end of the regulating sleeve tube is set with external thread, a rear part of the external thread cooperates with an internal thread of the front end of the body, and a front part of the external thread cooperates with an internal thread of the regulating nut. A rear end of the riveting guiding mouth connects with the front end of the regulating sleeve tube by thread.

In one embodiment, the riveting regulating mechanism further comprises a gasket. The gasket is set between the front end of the body and the regulating nut.

In one embodiment, the pulling rod comprises a through hole. The third pin shaft on the handle is connected to the pulling rod by the through hole.

In one embodiment, the grabbing mechanism comprises a grabbing piece, a grabbing piece seat, a plunger and a resetting spring, the grabbing piece is set in the grabbing piece seat; a front part of the plunger matches with a rear part of the grabbing piece, a rear part of the plunger matches with the resetting spring; the plunger and the resetting spring are set in an internal of the pulling rod.

In one embodiment, the internal of the pulling rod has a step; one end of the resetting spring elastically contacts with the step, other end of the resetting spring elastically contacts with rear end of the pulling rod.

In one embodiment, the second pin shaft is covered with a torsion spring, one end of the torsion spring contacts with the body or the first pin shaft other end of the torsion spring contacts with the handle.

In one embodiment, the body and handle are covered with a handle sleeve respectively.

In one embodiment, a hook is set on the body to lock the handle.

Compared with existing technology, the single handle pulling riveting gun of the present patent application has the following advantages:

The single handle pulling riveting gun of the present patent application uses three pin shafts to connect the body, handle and pulling rod. The second pin shat on the handle connects with the first pin shaft on the body by the moving piece. The third pin shat is fixed on the handle and the pulling rod simultaneously. When riveting, the second pin shaft moves towards the pulling rod, makes torque increase, thereby saving effort and energy.

In addition, the riveting journey can be adjusted by regulating front end of the body and the position of the regulating nut on the regulating sleeve tube. The use of the single handle pulling riveting gun of the present patent application is very convenient.

In Figures: 10: body; 11: handle; 12: handle sleeve; 13: hook; 20: pulling rod; 21: pulling rod position seat; 31: a first pin shaft; 32: a second pin shaft; 33: a third pin shaft; 40: moving piece; 50: torsion spring; 60: grabbing piece; 61, grabbing piece seat; 62, plunger; 63: resetting spring; 70: riveting guiding mouth; 71, regulating sleeve tube; 72: regulating nut; 73: gasket.

DETAILED DESCRIPTION

The present patent application will be further described with reference to the drawings. The following embodiments are used to illustrate the present patent application rather than limit the present patent application.

Embodiment 1

Figure 1:
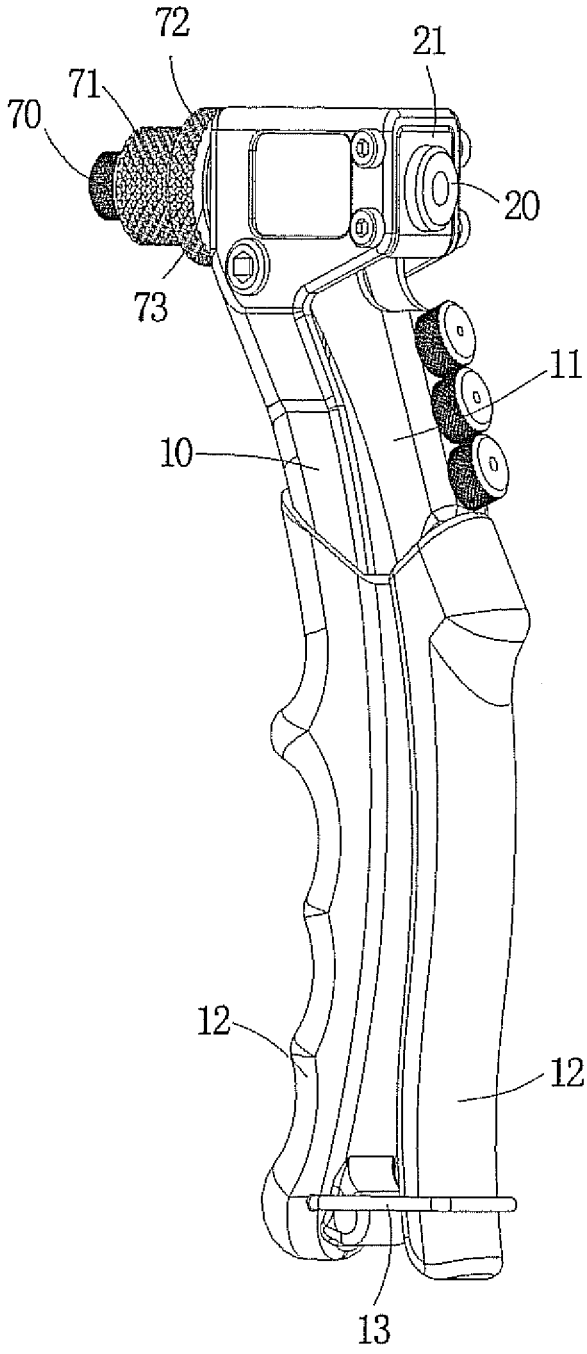
FIG. 1 illustrates the structure of a single handle pulling riveting gun according to one embodiment of the present patent application.
Figure 2:
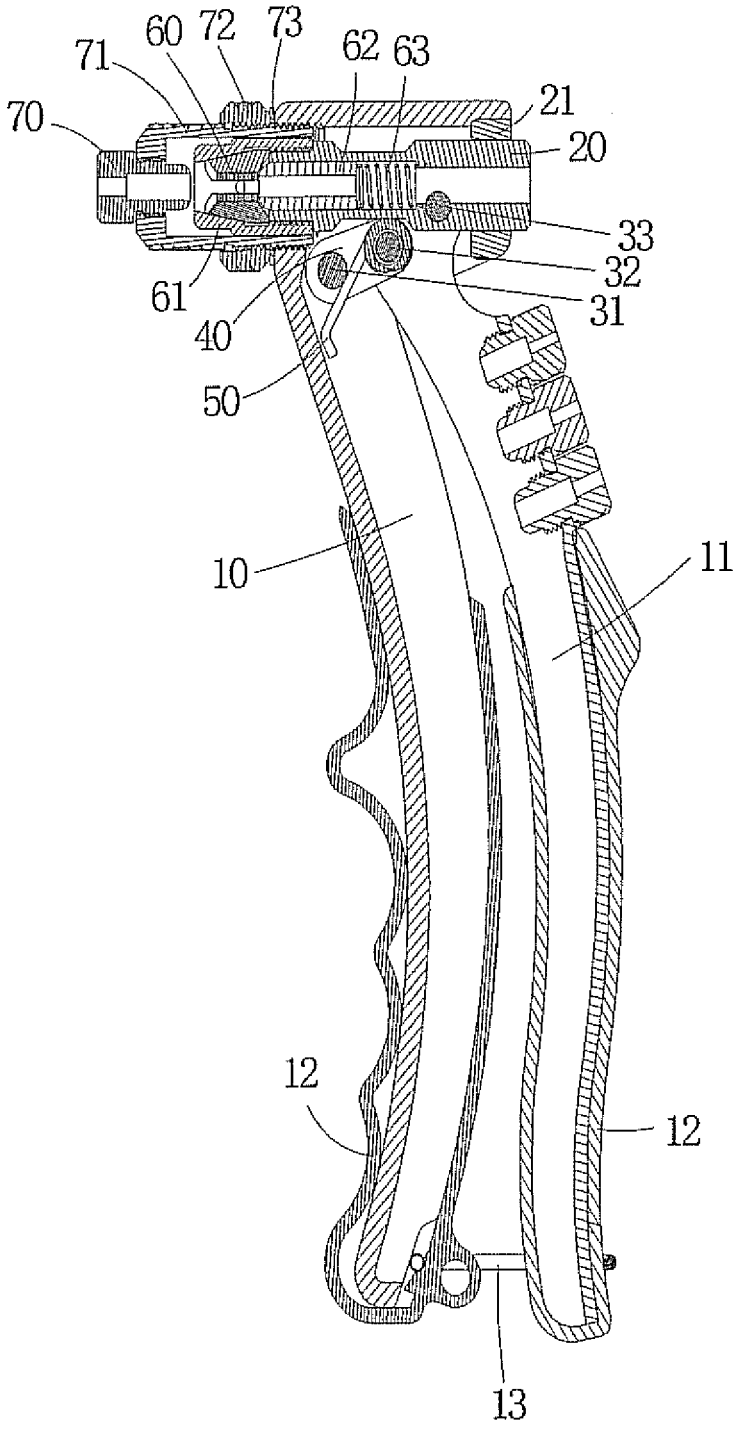
FIG. 2 illustrates the section view of the single handle pulling riveting gun according to one embodiment of the present patent application.
Figure 3:
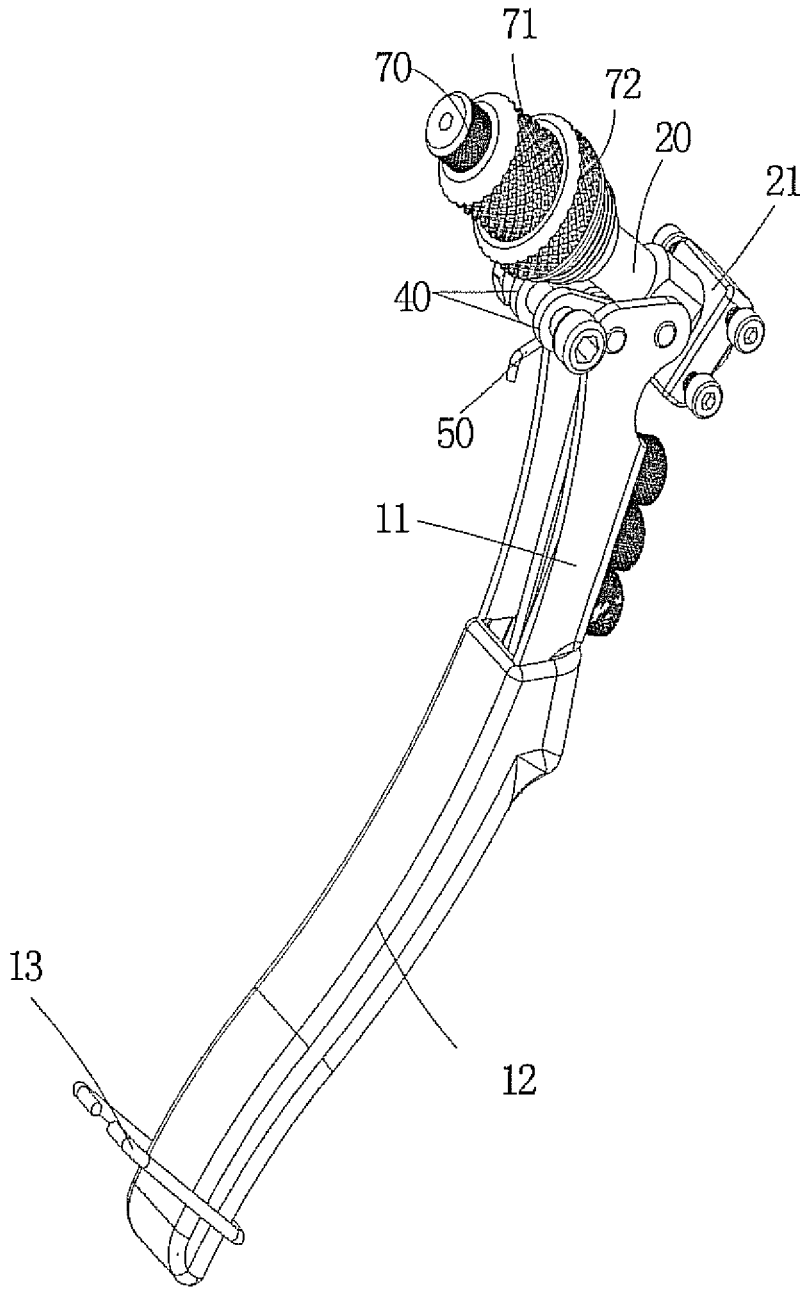
FIG. 3 illustrates the part structure of the single handle pulling riveting gun according to one embodiment of the present patent application.
Figure 4:
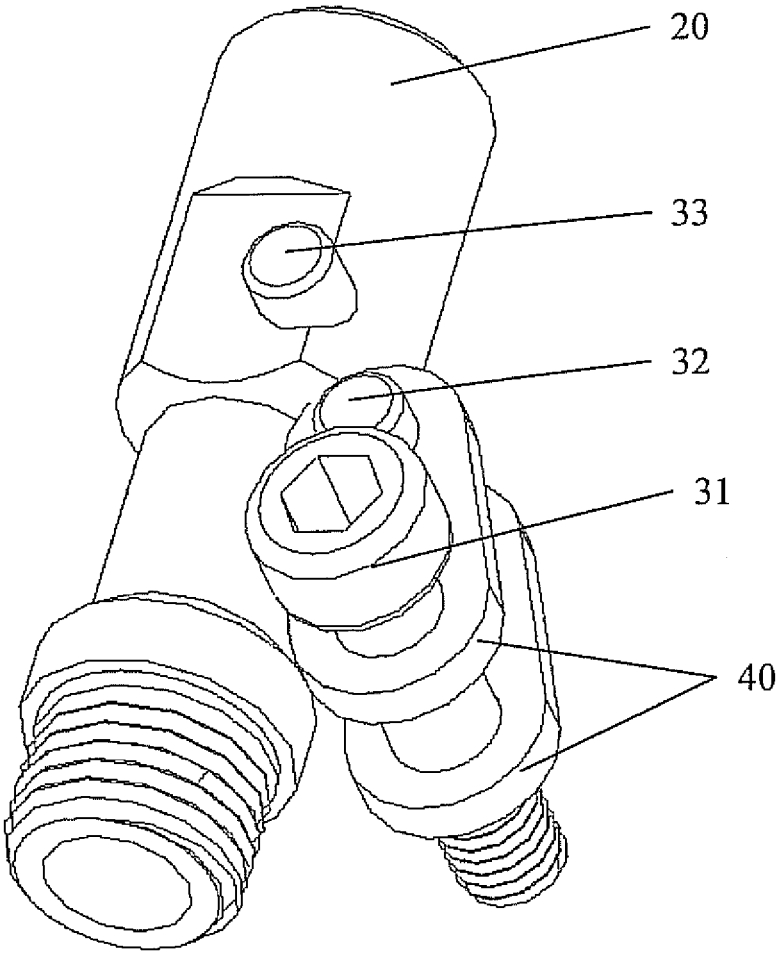
FIG. 4 illustrates the location of a pin shaft and pull rod according to one embodiment of the present patent application.

According to one embodiment of the present patent application and as shown in FIG. 1, FIG. 2 and FIG. 3, a single handle pulling riveting gun includes a body 10, a handle 11, a pulling rod 20, a grabbing mechanism, a riveting regulating mechanism, a first pin shaft 31, a second pin shaft 32, a third pin shaft 33 and a moving piece 40. The riveting regulating mechanism cooperates with a front end of the body 10. The grabbing mechanism is set on a chamber of the riveting regulating mechanism; a rear end of the grabbing mechanism cooperates with the pulling rod 20. The first pin shaft 31 is mounted on the body 10. The second pin shaft 32 is mounted on the handle 11 and connected with the first pin shaft 31 by the moving piece 40. The third pin shaft 33 is mounted on the handle 11 and the pulling rod 20 simultaneously. The position relationship of the first pin shaft 31, the second pin shaft 32, the third pin shaft 33 and the pulling rod 20 is shown in FIG. 4. The position relationship of the first pin shaft 31, the second pin shaft 32, the third pin shaft 33 and the pulling rod 20 is shown in FIG. 4. When riveting, the handle 11 moves towards the body 10, the second pin shaft 32 moves towards the pulling rod 20 under the action of moving piece 40. The torque increases. The less force and energy are required.

A rear end of the body is fixed with a pulling rod position seat 21. The riveting regulating mechanism includes a regulating sleeve tube 71. A rear end of the pulling rod 20 is located in the center hole of the pulling rod position seat. A front end of the pulling rod 20 stretches into the regulating sleeve tube 71. The pulling rod 20 moves linearly along a direction determined by the pulling rod position seat 21 and the regulating sleeve tube 71.

The riveting regulating mechanism includes a riveting guiding mouth 70, the regulating sleeve tube 71 and a regulating nut 72. A rear end of the regulating sleeve tube 71 is set with external thread. A rear part of the external thread cooperates with an internal thread of the front end of the body 10. A front part of the external thread cooperates with the internal thread of the regulating nut 72. The rear end of the riveting guiding mouth 70 connects with the front end of the regulating sleeve tube 71 by thread. The riveting regulating mechanism further includes a gasket 73. The gasket 73 is set between the front end of the body 10 and the regulating nut 72. In this embodiment, the riveting journey can be adjusted by the front end of the body 10 and the location of the regulating nut 72 on the rear end external thread of the regulating sleeve tube 71. This results a convenient use.

The pulling rod 20 has a through hole. The third pin shaft 33 on the handle 11 is connected to the pulling rod 20 by the through hole. The pulling rod 20 has a center hole for withdrawal nail.

The grabbing mechanism includes a grabbing piece 60, a grabbing piece seat 61, a plunger 62 and a resetting spring 63. The grabbing piece 60 is set in the grabbing piece seat 61. The front part of the plunger 62 matches with the rear part of the grabbing piece 60. The rear part of the plunger 62 matches with the resetting spring 63. The plunger 62 and resetting spring 63 are set in an internal of the pulling rod 20. The internal of the pulling rod 20 has a step. One end of the resetting spring 63 elastically contacts with the step. The other end of the resetting spring 63 elastically contacts with rear end of the pulling rod 62. In this embodiment, three grabbing pieces 60 locate in the grabbing piece seat 61 to form a grabbing part of the grabbing mechanism. The internal of the grabbing piece 60 has a rough grain. The rough grain increases the grabbing force between the grabbing piece 60 and riveting nail. Of course, the numbers of the grabbing piece 60 can varies according to actual situation. It can be two, four or others.

The second pin shaft 32 is covered with a torsion spring 50. One end of the torsion spring 50 contacts with the body 10 or the first pin shaft 31, the other end of the torsion spring 50 contacts with the handle 11.

The body 10 and handle 11 are covered with a handle sleeve 12 respectively. A hook 13 is set on the body 10 to lock the handle 11. The single handle pulling riveting gun is convenient and good to use because of the handle 12 and the hook 13.

Embodiment 2

In this embodiment, the riveting regulating mechanism has other structure. For example, a riveting opening can be set in the regulating sleeve tube 71. The size of the riveting opening can be the same with riveting nail exit in the riveting guiding mouth 71. No riveting guiding mouth 71 is required in this embodiment. The riveting journey can be adjusted by regulating the regulating sleeve tube 71. The use of the single handle pulling riveting gun is also very convenient.

The single handle pulling riveting gun of the present patent application uses three pin shafts to connect the body, handle and pulling rod. The second pin shat on the handle connects with the first pin shaft on the body by the moving piece. The third pin shat is fixed on the handle and the pulling rod simultaneously. When riveting, the second pin shaft moves towards the pulling rod, makes torque increase, thereby saving effort and energy. In addition, the riveting journey can be adjusted by regulating front end of the body and the position of the regulating nut on the regulating sleeve tube. The use of the single handle pulling riveting gun of the present patent application is very convenient.

Above is only embodiments of the present patent application, it should be noted that for the person skilled in the art can make some modifications without departing from the spirit and scope of the patent application.

What is claimed is:

1. A single handle pulling riveting gun comprising:

a body having a first pin shaft;

a handle having a second pin shaft;

a riveting regulating mechanism comprising:

a regulating sleeve tube;

a pulling rod position seat being mounted on the body (10);

a pulling rod;

a grabbing mechanism comprising:

a grabbing piece seat;

a grabbing piece being set in the grabbing piece seat and being used for grabbing a rivet;

a resetting spring being set in the pulling rod;

a plunger being set in the pulling rod and located between the grabbing piece and the resetting spring; and a moving piece connecting the first pin shaft and the second pin shaft;

wherein the handle and the body are connected by the first pin shaft, the second pin shaft and the moving piece;

the handle and the pulling rod are connected by a third pin shaft;

the pulling rod is located between the regulating sleeve tube and the pulling rod position seat; the pulling rod moves linearly along a direction determined by the pulling rod position seat and the regulating sleeve tube.

2. The single handle pulling riveting gun of claim 1, wherein the riveting regulating mechanism further comprises:

a riveting guiding mouth being connected with the regulating sleeve tube and used for guiding the rivet; and a regulating nut being connected with the regulating sleeve tube and used for adjusting a riveting route of the rivet.

3. The single handle pulling riveting gun of claim 2, wherein:

the riveting regulating mechanism further comprises a gasket being set between the body and the regulating nut.

4. The single handle pulling riveting gun of claim 1, wherein:

the second pin shaft is covered with a torsion spring, one end of the torsion spring contacts with the body or the first pin shaft, other end of the torsion spring contacts with the handle.

5. The single handle pulling riveting gun of claim 1, wherein:

the body and handle are covered with a handle sleeve respectively.

6. The single handle pulling riveting gun of claim 1, further comprising:

a hook being set on the body to lock the handle.

7. The single handle pulling riveting gun of claim 1, wherein:

the second pin shaft is covered with a torsion spring, one end of the torsion spring contacts with the body or the first pin shaft, other end of the torsion spring contacts with the handle.

8. The single handle pulling riveting gun of claim 1, wherein:

the body and handle are covered with a handle sleeve respectively.

9. The single handle pulling riveting gun of claim 1, further comprising a hook being set on the body to lock the handle.

* * * * *